US009431197B2

(12) United States Patent
Engewald

(10) Patent No.: US 9,431,197 B2
(45) Date of Patent: Aug. 30, 2016

(54) SWITCHING SYSTEM

(71) Applicant: ELLENBERGER & POENSGEN GMBH, Altdorf (DE)

(72) Inventor: Manuel Engewald, Nuremberg (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 0 days.

(21) Appl. No.: 14/274,903

(22) Filed: May 12, 2014

(65) Prior Publication Data

US 2014/0246403 A1 Sep. 4, 2014

Related U.S. Application Data

(63) Continuation of application No. PCT/EP2012/003457, filed on Aug. 14, 2012.

(30) Foreign Application Priority Data

Nov. 12, 2011 (DE) ..... 10 2011 118 418

(51) Int. Cl.

| | |
|---|---|
| ***H01H 1/22*** | (2006.01) |
| ***H01H 50/54*** | (2006.01) |
| ***H01H 33/18*** | (2006.01) |
| ***H01H 1/20*** | (2006.01) |
| ***H01H 9/36*** | (2006.01) |
| ***H01H 9/44*** | (2006.01) |

(52) U.S. Cl.

CPC ..... *H01H 33/182* (2013.01); *H01H 1/2041* (2013.01); *H01H 9/36* (2013.01); *H01H 9/443* (2013.01); *H01H 50/54* (2013.01)

(58) Field of Classification Search

CPC ..... H01H 33/66; H01H 9/44; H01H 9/443; H01H 1/22; H01H 33/18

USPC ..... 200/244, 400; 218/53, 78, 15–23, 31, 218/32, 149, 156; 335/16, 78, 147, 202

See application file for complete search history.

(56) References Cited

U.S. PATENT DOCUMENTS

| | | | | |
|---|---|---|---|---|
| 5,029,301 | A * | 7/1991 | Nebon et al. | 335/16 |
| 7,417,520 | B2 | 8/2008 | Kralik | |
| 2004/0021536 | A1 | 2/2004 | Harmon et al. | |
| 2008/0030289 | A1* | 2/2008 | Kralik | 218/26 |
| 2009/0134003 | A1* | 5/2009 | Okidate | 200/536 |

(Continued)

FOREIGN PATENT DOCUMENTS

| | | | |
|---|---|---|---|
| CN | 200972833 | Y | 11/2007 |
| DE | 10061394 | A1 | 6/2002 |

(Continued)

OTHER PUBLICATIONS

DE102007040164 translation, Erven Wolfgang,Feb. 2009,pp. 17.*

*Primary Examiner* — Amy Cohen Johnson
*Assistant Examiner* — Marina Fishman
(74) *Attorney, Agent, or Firm* — Laurence A. Greenberg; Werner H. Stemer; Ralph E. Locher

(57) ABSTRACT

A switching system has two contact points and a contact link disposed so at be rotatably movable about an axis of rotation of the contact link between the two contact points. The switching system further has at least one quenching chamber and a magnetic element for producing a magnetic field being parallel to the axis of rotation of the contact link, for driving an arc produced when the contact points are open into the quenching chamber.

11 Claims, 4 Drawing Sheets

(56) References Cited

U.S. PATENT DOCUMENTS

| | | | | |
|---|---|---|---|---|
| 2009/0278634 | A1 | 11/2009 | Lindsey et al. | |
| 2010/0044196 | A1* | 2/2010 | Dahl et al. | 200/244 |

FOREIGN PATENT DOCUMENTS

| | | | |
|---|---|---|---|
| DE | 102006035844 | B4 | 6/2008 |
| DE | 102007040164 | A1 | 2/2009 |
| DE | 102008009439 | A1 | 8/2009 |
| DE | 102008037967 | A1 | 2/2010 |
| DE | 102008049442 | A1 | 4/2010 |
| DE | 102009013337 | B4 | 1/2011 |
| EP | 0874380 | A1 | 10/1998 |
| GB | 2371409 | A | 7/2002 |

* cited by examiner

SWITCHING SYSTEM

CROSS-REFERENCE TO RELATED APPLICATION

This is a continuation application, under 35 U.S.C. §120, of copending international application No. PCT/EP2012/003457, filed Aug. 14, 2012, which designated the United States; this application also claims the priority, under 35 U.S.C. §119, of German patent application No. 10 2011 118 418.3, filed Nov. 12, 2011; the prior applications are herewith incorporated by reference in their entirety.

BACKGROUND OF THE INVENTION

Field of the Invention

The invention relates to a switching system containing a movable contact link between two contact points. The switching system is intended in particular for high DC voltages, preferably for a high-voltage direct current (HVDC) relay or for a contactor.

German patent DE 10 2009 013 337 B4 discloses a circuit breaker for direct current and alternating current containing two contact points. A contact link which is brought into the transverse direction when the circuit breaker is tripped is arranged between the contact points. The arcs produced out of the two contact points are driven by a blower. One of the two arcs is in this case blown as far as a peripheral region of the contact link, whereas one of the roots of the other arc is substantially brought into electrical contact with the two contact points by arc splitters. In other words, the two contact points are electrically short-circuited by the second arc, and the second arc takes on the electrical function of the contact link in the closed state. The second arc is therefore connected in parallel with the contact link. The first of the two arcs is quenched in the process. The remaining arc is driven by a further blower into a quenching chamber and is quenched there.

SUMMARY OF THE INVENTION

The invention is based on the object of specifying an improved switching system containing a contact link which is movable between two contact points. The switching system is intended to be suitable, preferably in conjunction with a switch in the form of a relay or contactor, for high DC voltages of at least 450 V, for example, and for carrying and isolating a continuous current of at least 250 A, for example.

The switching system has two contact points and a movable contact link arranged therebetween. The contact points are therefore connected electrically in series and are formed by in each case one fixed contact and one moving contact, which are used for conducting current, wherein the respective moving contact is fixedly connected to the contact link and moves with the contact link. Preferably, the fixed contacts are arranged on connecting rails which are bent approximately in the form of a U.

The contact link is rotatable about an axis of rotation, wherein the switching system is set either to a conducting state or to a non-conducting state by a rotation of the contact link about the axis of rotation. In other words, the contact points are opened or closed as a result of a rotary movement of the contact link, which will also be referred to below as a rotary link. The axis of rotation is preferably arranged centrally with respect to the contact link.

On opening of the contacts, i.e. on isolation of the moving contact from the respective fixed contact and, induced thereby, interruption of the current flow via the switching system, an arc can be produced at the contact points, via which arc, or via the plasma produced as a result, electrical current flows. Owing to the configuration of the switching system with a rotary link, in contrast to a linearly moved contact link the current direction in the plasma of the two partial arcs produced is in the same direction.

Preferably, the contact link consists of copper or another material which is a good conductor of electrical current. The contacts of the contact points and the connecting rails of the fixed contacts consist, in a suitable manner, from the same material as the contact link, preferably from copper.

In order to avoid damage and to achieve safe interruption of the current flow, the arc is driven by the magnetic field of a magnetic element into a quenching chamber. Expediently, the magnetic field is in this case at least partially perpendicular to the propagation direction of the respective arc, by which a Lorentz force is exerted on the respective arc. For example, the magnetic field within the switching system is substantially constant. Within the quenching chamber, the arc is quenched. For this, suitably the electrical voltage which is required for maintaining the arc is increased to a value which is above the voltage which is present at the switching system.

The switching system is operated in particular by direct current, wherein an electrical current of between 2 A and 500 A flows via the rotary link of the switching system. Suitably, the electrical current is 250 A, by which the switching system is operated continuously. Expediently, the electrical voltage which is present at the switching system is between 30V and 1000V, for example between 450V and 800V.

In a preferred embodiment, the contact link is connected to a bearing part in radially movable and/or rotationally movable fashion. The connection is performed suitably indirectly via a rotary link mount, on which the contact link is held. The bearing part is in this case rotatable about the axis of rotation, while the rotary link mount is guided in at least one, preferably in two, radial slot-like guide contours of the bearing part. Particularly preferably, two bearing parts and two rotary link mounts are provided, between which the contact link is inserted or held. A rotation of the or each bearing part about the axis of rotation effects a transfer of the switching system from the closed state into the open state and therefore from the conducting state into the non-conducting state. Therefore, the interruption of the circuit is ensured by a rotation of the bearing part about the axis of rotation and therefore an isolation of the fixed contact(s) from the moving contact(s). The or each rotary link mount is in this case connected in rotationally movable fashion to the bearing part and expediently has a radial bearing play relative to the respective bearing part.

The position of the rotary link mount and therefore in particular the position of the contact link are therefore changeable relative to the bearing part and the axis of rotation. Therefore, the rotary link mount is preferably mounted in floating fashion in relation to the bearing part, i.e. can be brought into a transverse or tangential position in relation to the bearing part. In this case, the movability is comparatively insubstantial. In particular, the rotary movability of the rotary link mount with respect to the bearing part is less than the rotary movability of the bearing part in relation to the fixed contacts. It is thus possible for comparatively large manufacturing tolerances to be provided in the manufacture of the circuit breaker, wherein nevertheless safe operation is ensured. In addition, the length of use of the circuit breaker is increased since changes to the contacts owing to erosion or contamination can be compensated for by the floating suspension.

Preferably, a continuous operation of the contact link, which is expediently accommodated by the two electrically insulating and thermally particularly stable rotary link mounts, is achieved as a result of the contact link which is arranged only indirectly on a rigid spindle by virtue of the contact link preferably being coupled to in each case one rotatable bearing part on both sides. The coupling is performed in this case suitably via in each case one spring, preferably on both sides. The spring is tensioned (biased) with the contact points of the switching system closed, i.e. in the switched-on state, and therefore generates a particularly effective contact pressure of the moving contacts on the fixed contacts. As a result of this spring-loaded floating mounting of the contact link, it is ensured that the contact pressure is always distributed uniformly among both contact points and the contacts there, even in the case of different contact erosion at the contact points. An additionally realized reserve of spring force of the or each spring is particularly expedient for erosion compensation. In addition, the springs, which will also be referred to below as contact pressure springs, contribute to the acceleration of the contact link.

The radial movability of the contact link with respect to the bearing part is preferably realized by virtue of the fact that the respective rotary link mount is guided in at least one, preferably in two, radial guide contours of the bearing part. Bearing elements which are provided on the rotary link mount, preferably integrally formed thereon, receive the spring ends of the respective contact pressure springs. These bearing elements lie or engage in cutouts in the bearing part. The cutouts are in the form of a circular arc and perform practically no guide function for the rotary link mount, in order to avoid excessive precision and therefore jamming of the movable rotary link mount with respect to the bearing part.

In a suitable configuration, the respective spring is positioned between two supporting elements of the bearing part. The expediently cylindrical supporting elements are arranged in the region of the rotary axis of the bearing part and therefore centrally with respect thereto one behind the other between the guide contours and possibly between the cutouts in the bearing part. The respective spring which is inserted between the two supporting elements, which are preferably integrally formed on the respective bearing part, is bent approximately in the form of a z in this region.

In a suitable embodiment, the quenching chamber has a number of radially running arc splitter plates. In other words, the arc splitter plates are arranged in the manner of a fan, wherein the distance between two adjacent arc splitter plates is increased as the distance from the axis of rotation increases. Suitably, two groups of these arc splitter plates arranged in the form of a fan are formed, wherein regions free of arc splitter plates are formed between these arc splitter plate groups on opposite sides. Preferably in each case one U-shaped connecting rail is arranged and is fitted, expediently so as to run radially, in these regions. The respective connecting rail bears in each case one of the fixed contacts, which, together with the moving contacts borne by the contact link, form the two contact points.

The voltage which is required to maintain an arc formed between the arc splitter plates rises as the distance of the arc from the axis of rotation increases. The arc which is produced at an operating voltage and is driven into the quenching chamber therefore collapses when the arc has moved far enough into the quenching chamber and away from the axis of rotation. The movement expediently takes place likewise by the magnetic element. In this way, the arc is quenched.

Particularly preferably, the switching system is configured to be substantially point-symmetrical and/or rotationally symmetrical with respect to the axis of rotation. In particular, the circuit breaker contains two quenching chambers. Owing to this design, the switching system can be operated safely in both current directions, wherein in each case one of the quenching chambers quenches the arc which is produced during operation in one of the current directions on opening of the contact points. In particular, an orientation of the circuit breaker does not need to be taken into consideration during installation of the switching system in the case of DC operation.

Expediently, the magnetic element has two iron plates, which substantially cover the contact link and are arranged in such a way that the axis of rotation is perpendicular to the iron plates. In this case, the contact link is located in particular between the two plates. The contact link is therefore arranged rotatably, without one of the plates restricting this movability.

At least one permanent magnet is in magnetic contact with at least one of the plates and in particular both plates. In this case, expediently the respective permanent magnet is in mechanical contact with the plates either directly or indirectly via a further ferromagnetic element, such as an iron bar, for example. The permanent magnet magnetizes the plates in such a way that a substantially constant magnetic field is formed between the plates. This magnetic field passes through the contact link and drives the arcs produced on opening of the contact points into the quenching chamber. In particular, the magnetic element is not arranged rotationally symmetrically, but eccentrically to the axis of rotation at a specific position.

In particular, the magnetic field which is produced by the magnetic element is parallel to the axis of rotation of the contact link. In this way, the arc produced on opening of the contact points is driven in the radial direction. Any components of the circuit breaker which adjoin the contact points along the axis of rotation are protected and are not damaged by the arc. In particular, the bearing part and/or the iron plates of the magnetic element are not detected by the arc.

The nature of the connection of the contact link of the switching system to the bearing part can also be independent of the magnetic element and the quenching chamber. Rather, this is considered to be an independent invention.

Other features which are considered as characteristic for the invention are set forth in the appended claims.

Although the invention is illustrated and described herein as embodied in a switching system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Mutually corresponding parts have been provided with the same reference symbols in all of the figures.

Figure 1:
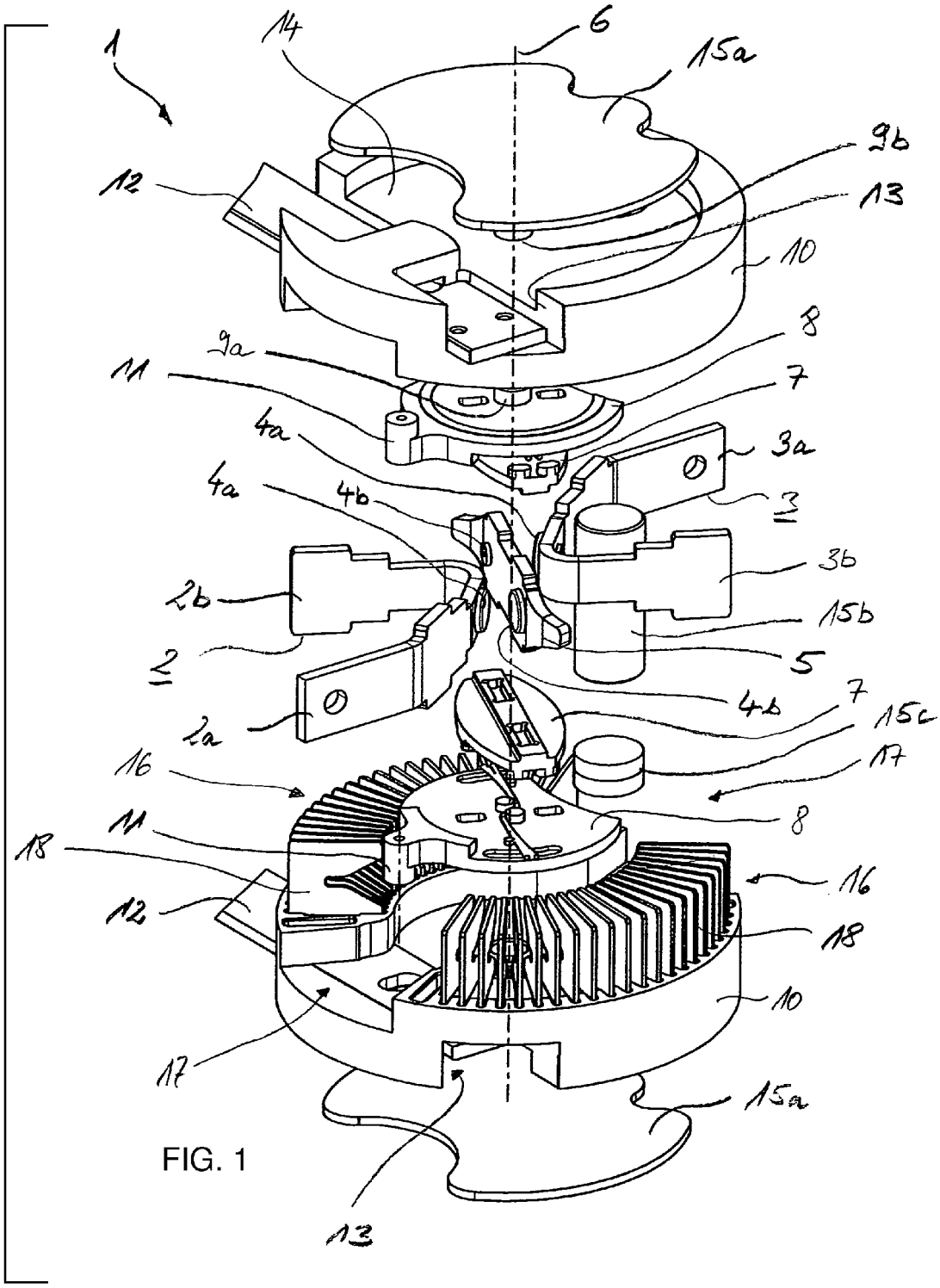
FIG. 1 is a diagrammatic, exploded perspective view of a switching system according to the invention containing a rotationally movable contact link (rotary link) and two quenching chambers.
Figure 5:
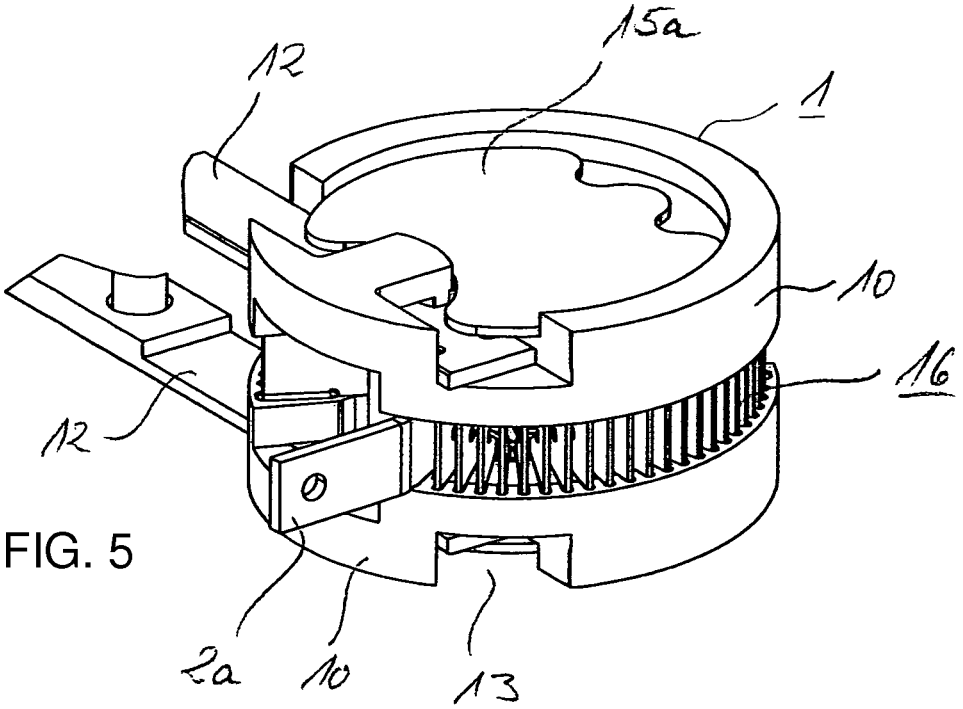
FIG. 5 is a perspective view of the switching system shown in FIG. 1 in the assembled state.

Referring now to the figures of the drawings in detail and first, particularly to FIGS. 1 and 5 thereof, there is shown a switching system 1 intended in particular for direct current and preferably in connection with an HV relay in an exploded drawing and in the assembled state, respectively. A circuit (not shown in more detail) is safeguarded by the switching system 1, wherein two connections 2*a*, 3*a* of the switching system 1 are electrically conductively connected to further elements of the circuit, such as electrical cables or the like. The circuit can conduct a continuous electrical current of 250 A or, for example, also a current of 600 A for 50 ms. The electrical voltage which is present at the connections 2*a*, 3*a* is between 450V and 800V during normal operation.

The connections 2*a*, 3*a* are formed by rail limbs of connecting rails 2, 3 which are bent approximately in the form of a U, which connecting rails each have a fixed contact 4*a* in the region of the kink or bend. In the event of contact, in each case one moving contact 4*b* is in mechanical and electrical contact with each fixed contact 4*a*, and these contacts together each form a contact point 4*a*, 4*b*. The respective further, comparatively short rail limb 2*b*, 3*b* of the connecting rails 2 and 3, respectively, likewise runs approximately radially in the same way as the comparatively long connecting or rail limbs 2*a*, 3*a*.

The moving contacts 4*b* are borne by a contact link 5 consisting of copper, which is rotatable about an axis of rotation 6. For this, the contact link 5 is inserted into in each case one rotary link mount 7 on both sides. Each rotary link mount 7, which is manufactured from an electrically insulating and thermally comparatively stable material, is connected to a bearing part 8. Therefore, the rotary link mount 7 receives the contact link 5 and the bearing parts 8 receive the rotary link mount 7 between them.

Each bearing part 8 has, substantially in the center, facing away from the rotary link mount 7, a bearing pin 9*a*, which engages in a corresponding bearing recess 9*b* within a housing cover, referred to below as housing part, or a housing half-shell 10. The bearing pins 9*a* and the bearing recess 9*b* together each form a bearing point, with the aid of which the contact link 5 can be pivoted about the axis of rotation 6. A cam 11 is fitted to each bearing part 8 in the respective peripheral region thereof eccentrically with respect to the respective bearing 9*a*, 9*b*, which cam engages in a coupling rod 12. Each coupling rod 12 is guided within a guide contour or groove 13 of the respective housing part 10, the guide contour facing away from the bearing part 8, with the result that a transverse movement of the coupling rod 12 results in a rotation of the bearing part 8 about the axis of rotation 6.

Each housing cover 10 also has a cutout 14, which adjoins the respective guide groove 13. An iron plate 15*a* of a magnetic element 15 (FIG. 4) is inserted in the respective cutout 14. The size of the iron plates 15*a* or the dimensions thereof are in this case such that the contact link 5 is covered by the iron plates 15*a*. In other words, each projection of the contact link 5 along the axis of rotation 6 onto each plane within which one of the iron plates 15*a* lies is covered by the respective iron plate 15*a*.

Two semicircular quenching chambers 16 are arranged around the contact link 5 radially with respect to the axis of rotation 6. Two regions 17 without arc splitter plates (regions free of arc splitter plates) are arranged between the two quenching chambers 16, with the connecting rails 2, 3 being arranged in the regions 17. Each quenching chamber 16 has a plurality of radially running arc splitter plates 18 extending parallel to the axis of rotation 6. The arc splitter plates 18 are thus fanned out and the distance between two adjacent arc splitter plates 18 increases as the distance from the axis of rotation 6 increases. The arc splitter plates 18 or the quenching chambers 16 and the shaped connecting rails 2, 4 surround the contact link 5 completely in the radial direction, wherein the contact link 5 is movable by the bearing part 8 along the quenching chambers 16.

In the assembled state, the switching system 1 is substantially cylindrical, wherein the iron plates 15*a* and parts of the housing covers 10 form the respective base areas. The lateral surface areas contain the quenching chambers 16 and likewise parts of the housing covers 10. With the exception of both the magnetic element 15 and the coupling rod 12 as well as the cam 11 associated with the coupling rod 12, the switching system 1 is configured to be substantially rotationally symmetrical with respect to the axis of rotation 6 and point-symmetrical with respect to a point lying on the axis of rotation 6.

Figure 2:
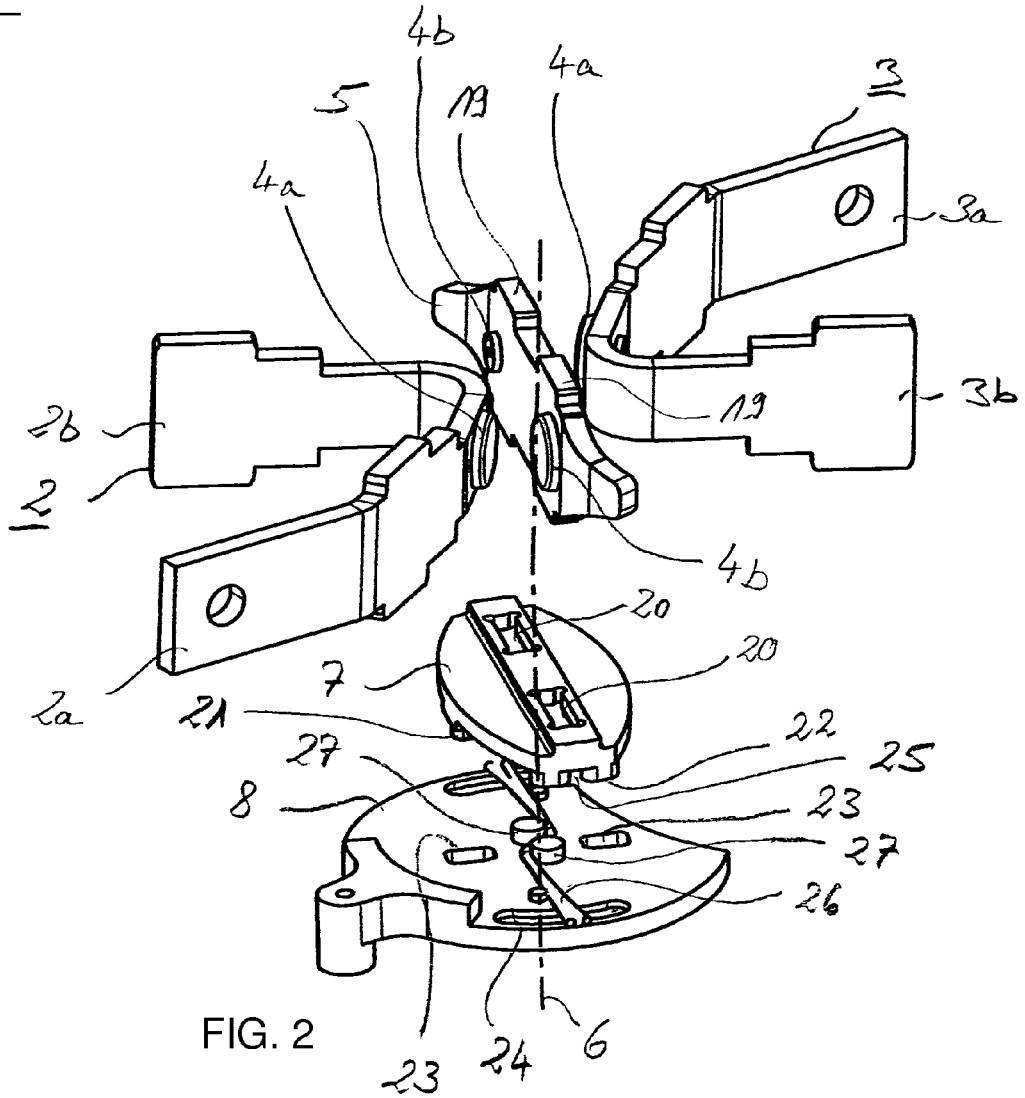
FIG. 2 is an exploded, perspective view of a rotary link.

FIG. 2 shows an exploded illustration of the contact link 5, one of the rotary link mounts 7 and one of the bearing parts 8. The rotationally symmetrical contact link 5 contains four plug-in bevels or tongues 19, of which in each case two are plugged into two receiving openings or grooves 20 in the rotary link mount 7 and rest therein in a form-fitting and/or force-fitting manner. The rotary link mount 7 has two guide pins 21 and two bearing elements 22 on the lower side facing away from the contact link 5, of which guide pins and bearing elements in each case one is visible. Each guide pin 21, in the assembled state, rests in a radially running, slot-like guide contour 23 of the bearing part 8. Owing to the shaping of the guide contour 23, the rotary link mount 7 can, in the fitted state, be shifted relative to the bearing part 8 along a radial bearing play. The rotary link mount 7 and therefore the contact link 5 borne thereby is therefore mounted in floating fashion.

Each bearing element 22 rests in a tangentially running, bent or curved recess 24 in the bearing part 8. By means of the configuration of the cutout 24 and owing to at least a small amount of play for the rotary link-side guide pins 21 in the bearing part-side guide contours 23, the rotary link mount 14 is rotationally movable through an angle of at most 5° about the axis of rotation 6 in relation to the bearing part 8.

The bearing element 22 is slotted, in particular in the center. The spring ends of a spring 26, which is configured in the form of a leaf spring and acts as a rotary and contact pressure spring, rest in the corresponding slots or notches 25. The spring 26 is bent about two raised, cylindrical supporting elements 27 of the bearing part 8 which are arranged in the region of the axis of rotation 8. The spring 26 is biased in the closed state of the contact points 4*a*, 4*b* and thus produces a desired or required contact pressure of the contact link 5 on the connecting rails 2, 3. In conjunction with the floating mounting of the contact link 5, the spring 26, in the switched-on state of the switching system 1, ensures that, even in the event of different contact erosion of the contacts 4*a*, 4*b*, the contact pressure is always distributed uniformly among the contact points 4*a*, 4*b*. In the event of a movement of the rotary link mount 7 relative to the bearing part 8, the spring 26 is bent and therefore a spring force is generated, which drives the rotary link mount 7 into its original position and therefore the contact link 5 into the closing state.

Owing to the floating arrangement of the rotary link mount 7 or the contact link 5 in relation to the bearing part 8, it is possible for comparatively high manufacturing tolerances to be permitted during manufacture of the switching system 1. In the event of a rotation of the bearing part 8 about the axis of rotation 6 out of the contact position, the contact between the contacts 4*a*, 4*b* is maintained by the spring 26 until the guide pins 21 bear against the guide contour 23 of the bearing part 8 or the spring 26 is relieved of strain. By a rotation of the bearing part 8 beyond this state, the contact points 4*a*, 4*b* are opened.

Figure 4:
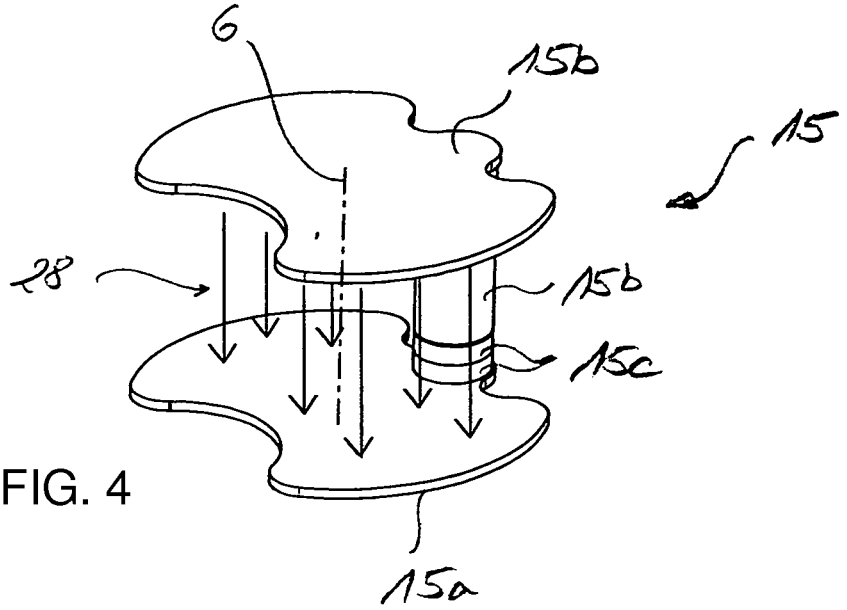
FIG. 4 is a perspective view of a magnetic element of the switching system.

FIG. 4 illustrates a perspective view of the assembled magnetic element 15. An iron bar 15*b* and, coaxially with respect thereto, two permanent magnets 15*c* are arranged between the two mutually parallel iron plates 15*a*. The iron bar and the permanent magnets are parallel to the axis of rotation 8 and connect the two iron plates 15*a* magnetically to one another. The permanent magnets 15*c* in the process magnetize both the iron bar 15*b* and the iron plates 15*a*, which therefore adhere to one another. Therefore, no further adhesive or mounting device is required for mounting the magnetic element 15. In order to increase the stability, however, they can also be adhesively bonded or screwed. The two permanent magnets 15*c* are magnetized and arranged in relation to one another in such a way that a substantially homogeneous magnetic field 28, whose direction is parallel to the axis of rotation 8, is formed between the two iron plates 15*a*.

Figure 3B:
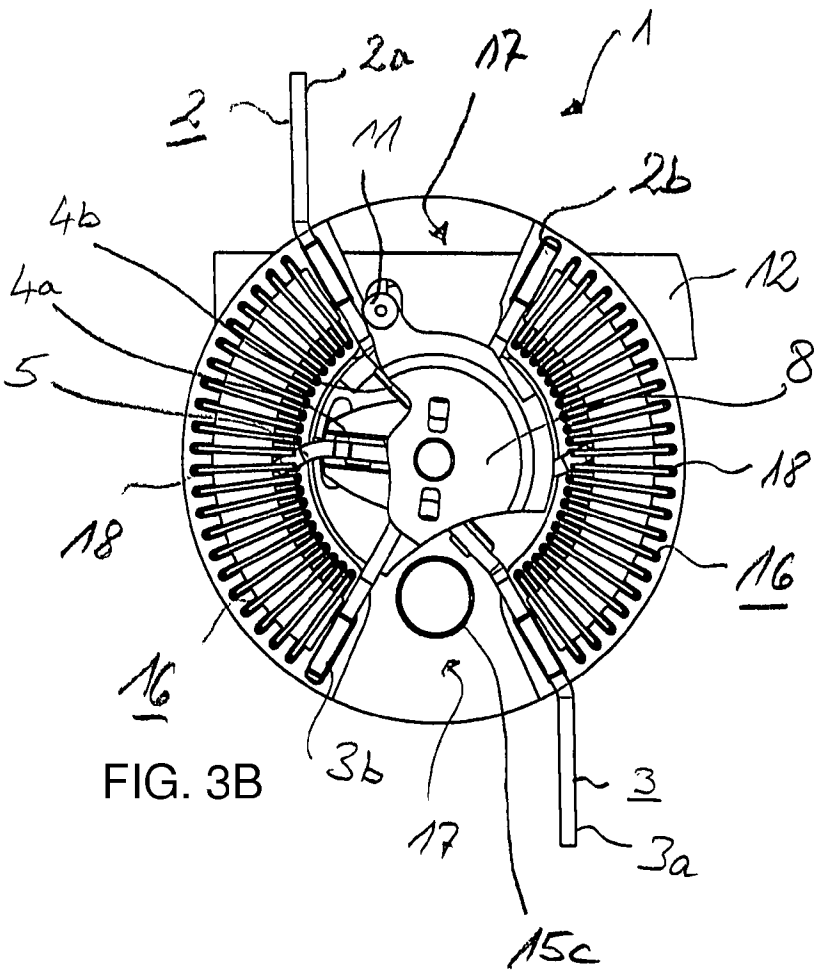
FIGS. 3A & 3B are plain views of the switching system with contacts closed and contacts open, respectively.
Figure 3A:
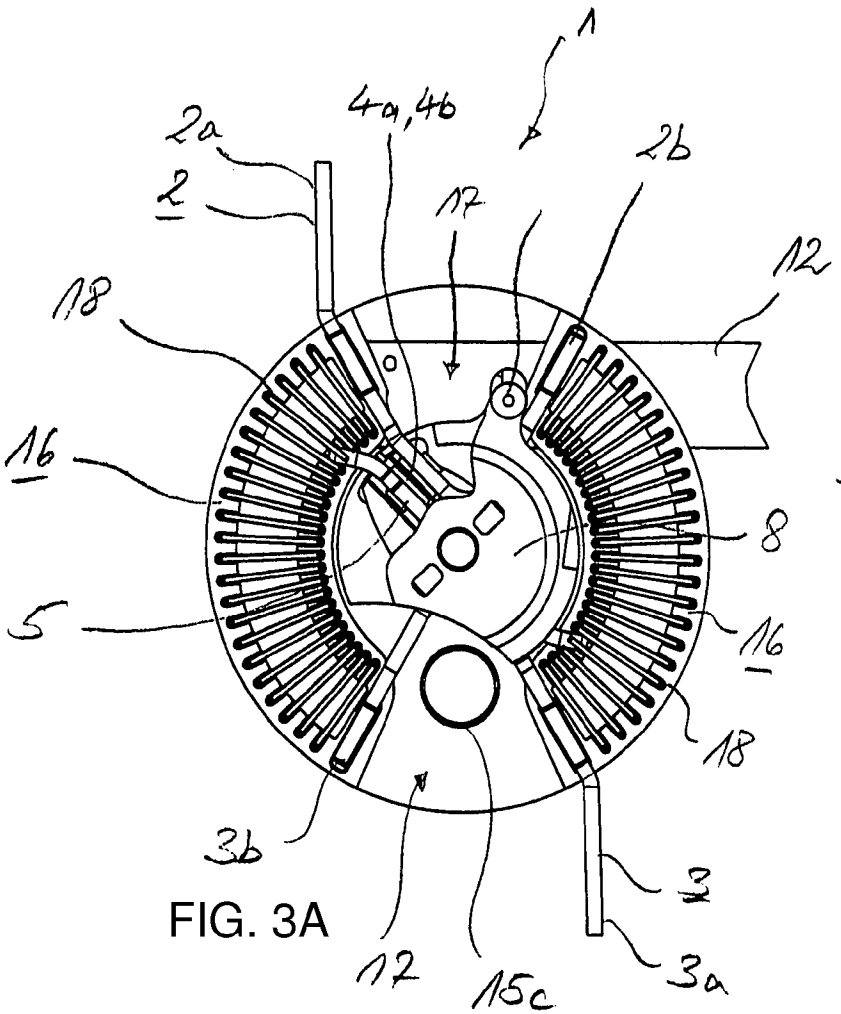

FIGS. 3A and 3B show the switching system 1 in the closed and open state, respectively. In the contact state, an electrical current flows via the connecting rails 2 and 3, the contact points 4*a*, 4*b* and the contact link 5. The fixed contacts 4*a* are in direct mechanical and electrical contact with the respective moving contacts 4*b* (FIG. 3A). In the event of a malfunction within the circuit, the bearing part 8, by means of the coupling rods 12, and also the contact link 5 are rotated about the axis of rotation 6 and therefore the moving contacts 4*b* are mechanically isolated from the associated fixed contacts 4*a*. Owing to the level of the electrical current and the level of the electrical voltage, in each case a first arc and a second arc are formed between the contacts. In this case, owing to the arcs, the current continues to flow via the switching system 1.

The magnetic field 28 produced by the magnetic element 15 brings about a Lorentz force acting on the arcs, with the result that the arcs are deflected perpendicular to their direction of propagation and perpendicular to the magnetic field 28. Therefore, the arcs are moved away from the contact points 4*a*, 4*b* for a comparatively short period of time, which protects the contacts of the contact points from excessive loading and damage. Owing to the alignment of the arcs, the arcs are moved by means of the magnetic field 28 in the same direction and towards the same quenching chamber 16. Owing to both the continued rotation of the contact link 5 about the axis of rotation 6 and the increasing distance of the respective arc from the axis of rotation 6, the length of the first arc is extended. The other arc, on the other hand, is moved towards the axis of rotation 6, for which reason its length changes comparatively little. As the length of each of the arcs increases, the electrical voltage which is required for maintaining the arcs increases. If this voltage exceeds the electrical voltage which is already present at the switching system 1, the arcs are quenched. The current flow via the switching system 1 is thus interrupted.

The respective arc is driven into the corresponding arc splitter stack of the quenching chamber 16 by the magnetic field 28. There, the arc is split up into a number of partial arcs between the individual arc splitter plates 18. The electrical voltage which is required for maintaining the current flow through the switching system 1 is thus increased again. By the magnetic field 28, the second arc is moved from that side of the contact link 5 which faces away from the first arc to that side of the switching system 1 on which the quenching chamber 16 with the first arc is arranged. The second arc is accelerated radially outwards onto this quenching chamber 16 by the magnetic field 28. Owing to the rotation, the length of the second arc can be shortened or remain constant. The movement in the radial direction results in an enlargement of its length. These two effects result in the length of the second arc remaining substantially constant, wherein, in the event that the level of the axis 6 is exceeded, the second arc is widened considerably.

If the contact link 5 cannot be rotated further, the second arc is not shortened any further owing to the rotation. Instead, its length increases as the distance from the axis of rotation 6 increases. In the respective quenching chamber 16, the second arc is likewise split up into a number of partial arcs between the individual arc splitter plates 18. This and the movement of the partial arcs radially outwards by means of the magnetic field 28 and therefore an enlargement of the length of each partial arc result in quenching of the individual partial arcs. The current flow via the switching system 1 is thus interrupted and components of the circuit are protected from overload.

The invention is not restricted to the above-described exemplary embodiment. Instead, other variants of the invention can also be derived from this by a person skilled in the art without departing from the subject matter of the invention. In particular, in addition all individual features described in connection with the exemplary embodiment can also be combined with one another in another way without departing from the subject matter of the invention.

The following is a summary list of reference numerals and the corresponding structure used in the above description of the invention.

| List of Reference Symbols: | |
|---|---|
| 1 | Switching system |
| 2 | Connecting rail |
| 2a | Limb/connection |
| 2b | Rail limb |
| 3 | Connecting rail |
| 3a | Limb/connection |
| 3b | Rail limb |
| 4a | Moving contact |
| 4b | Fixed contact |
| 5 | Contact link |
| 6 | Axis of rotation |
| 7 | Rotary link mount |
| 8 | Bearing part |
| 9a | Bearing pin |
| 9b | Bearing recess |
| 10 | Housing cover |
| 11 | Cam |
| 12 | Coupling rod |

-continued

| List of Reference Symbols: | |
|---|---|
| 13 | Guide contour/groove |
| 14 | Cutout |
| 15 | Magnetic element |
| 15a | Iron plate |
| 15b | Iron bar |
| 15c | Permanent magnet |
| 16 | Quenching chamber |
| 17 | Region free of plates |
| 18 | Arc splitter plate |
| 19 | Plug-in bevel/tongue |
| 20 | Receiving opening/ groove |
| 21 | Guide pin |
| 22 | Bearing element |
| 23 | Guide contour |
| 24 | Cutout |
| 25 | Notch/slot |
| 26 | Spring |
| 27 | Supporting element |
| 28 | Magnetic field |

The invention claimed is:

1. A switching system, comprising:

two contact rails each having a rail contact point;

a contact link having two link contact points and disposed rotatably movable about an axis of rotation of said contact link, when said contact link is rotated to a contact position, each of said link contact points is in direct contact with one of said rail contact points defining a closed contact;

at least one quenching chamber;

a magnetic element for producing a permanent magnetic field, the permanent magnetic field being parallel to said axis of rotation of said contact link, for deflecting an arc into said quenching chamber and produced when said link contact points are no longer directly contacting said rail contact points;

a rotary link mount;

a bearing part connected to said contact link in at least one of a radially movable fashion by means of said rotary link mount or in a rotationally movable fashion relative to said bearing part, said bearing part having tangentially running cutouts formed therein;

at least one spring, said contact link being coupled to said bearing part by means of said at least one spring biased with said closed contact; and said rotary link mount having bearing elements resting in said tangentially running cutouts, said bearing elements receiving said spring on a spring-end side.

2. The switching system according to claim 1, wherein said bearing part has a top surface with an outer periphery and said tangentially running cutouts are formed at said outer periphery.

3. The switching system according to claim 1, wherein said bearing part has at least one radial guide contour formed therein and said rotary link mount is guided in said at least one radial guide contour.

4. The switching system according to claim 1, wherein said bearing part has two supporting elements and said spring is positioned between said two supporting elements.

5. The switching system according to claim 4, wherein:

said radial guide contour is one of a plurality of radial guide contours; and said supporting elements are disposed one behind the other between said radial guide contours and/or said tangentially running cutouts of said bearing part, and said spring is bent approximately in a form of a z between said supporting elements.

6. The switching system according to claim 1, wherein said quenching chamber has a number of radially running arc splitter plates.

7. The switching system according to claim 6, wherein:

said contact rails are bent connecting rails each having said rail contact point being a fixed rail contact point; and said link contacts are moving contacts.

8. The switching system according to claim 7, wherein said at least one quenching chamber has two regions without any said arc splitter plates and disposed between said arc splitter plates, in said regions said bent connecting rails are inserted.

9. The switching system according to claim 1, wherein the switching system has a substantially point-symmetrical and/or rotationally symmetrical design with respect to said axis of rotation.

10. The switching system according to claim 1, wherein said magnetic element has at least one permanent magnet and two iron plates in magnetic contact therewith, which are disposed substantially perpendicular to said axis of rotation and at least partially cover said contact link.

11. The switching system according to claim 1, wherein the switching system is selected from the group consisting of a relay or a contactor.

* * * * *